US008262807B2

(12) United States Patent
Son

(10) Patent No.: US 8,262,807 B2
(45) Date of Patent: Sep. 11, 2012

(54) DISH WASHING MACHINE

(75) Inventor: Wang Seok Son, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1015 days.

(21) Appl. No.: 11/976,068

(22) Filed: Oct. 19, 2007

(65) Prior Publication Data

US 2008/0134728 A1 Jun. 12, 2008

(30) Foreign Application Priority Data

Dec. 6, 2006 (KR) ..... 10-2006-0123118

(51) Int. Cl.
*B08B 3/00* (2006.01)

(52) U.S. Cl. ..... 134/56 D; 134/57 D

(58) Field of Classification Search ..... None
See application file for complete search history.

(56) References Cited

U.S. PATENT DOCUMENTS 6,138,692 A * 10/2000 Kobos et al. ..... 134/25.2

FOREIGN PATENT DOCUMENTS

| | | |
|---|---|---|
| DE | 35 33 719 | 3/1987 |
| EP | 0 858 768 | 8/1998 |
| GB | 2 238 468 | 6/1991 |
| JP | 2005-118283 | 5/2005 |
| JP | 2006-75643 | 3/2006 |
| KR | 10-2006-0095841 | 9/2006 |
| WO | 94/18686 | 8/1994 |
| WO | 01/10284 | 2/2001 |

OTHER PUBLICATIONS

Ikeda, Yoshio, May 2005, JP 2005-118283, English machine translation.*

European Search Report issued May 20, 2008 in corresponding European Patent Application No. 07119483.1-2314.

Korean Office Action for corresponding Korean Patent Application No. 10-2006-0123118 dated Jul. 27, 2011.

* cited by examiner

*Primary Examiner* — Michael Barr
*Assistant Examiner* — Jason Ko
(74) *Attorney, Agent, or Firm* — Staas & Halsey LLP

(57) ABSTRACT

A dish washing machine, which is capable of preventing wet vapor from flowing to a control panel provided to a door when the air in the door which opens and closes a washing tub is changed into the wet vapor due to a change in temperature during operation. The dish washing machine includes a main body having a washing tub, a door hinged with the main body, and opening and closing the washing tub, a control panel provided to the door, and a partition provided between the door and the control panel so as to block wet vapor in the door from flowing to the control panel.

18 Claims, 5 Drawing Sheets

DISH WASHING MACHINE

CROSS-REFERENCE TO RELATED APPLICATIONS

This application claims the benefit of Korean Patent Application No. 10-2006-0123118, filed on Dec. 6, 2006, in the Korean Intellectual Property Office, the disclosure of which is incorporated herein by reference.

BACKGROUND OF THE INVENTION

1. Field of the Invention

The present invention relates to a dish washing machine. More particularly, to a dish washing machine which prevents wet vapor generated in a door from penetrating into a control panel that is coupled with and moved with the door.

2. Description of the Related Art

A conventional dish washing machine includes a main body having a washing tub, a door pivotably provided to the main body, and opening and closing the washing tub, and a control panel that is installed to an upper portion of the door, and having operation buttons required to operate the dish washing machine and a display unit displaying an operation state.

An internal space of the door communicates with an internal space of the control panel. A printed circuit board (PCB) to which the operation buttons and the display unit are connected is disposed in the control panel. Wires extending from the PCB extend to a lower portion of the main body via inner portions of the control panel and the door, and thereby are connected with various components such as a sump provided at the lower portion of the main body.

When the dish washing machine is operated to wash dishes, cold washing water flowing into the washing tub is heated into hot washing water by means of a heater in the washing tub. This hot washing water is sprayed upon the dishes through rotary nozzles provided to the sump and the washing tub, thereby washing the dishes.

However, when the dishes continue to be washed in this way, the temperature in the dish washing machine increases continuously, which can influence air in the door.

In particular, when wet vapor in the washing tub penetrates into the door and then moves to the control panel, it influences the PCB on which electric and electronic devices are mounted. Therefore, it is impossible to eliminate the possibility of malfunction.

SUMMARY OF THE INVENTION

Accordingly, it is an aspect of the present invention to provide a dish washing machine which avoids malfunction and breakdown by preventing wet vapor penetrating into a door from influencing electrical and electronic elements mounted in a control panel.

It is another aspect of the present invention to provide a dish washing machine capable of rapidly discharging water droplets which moisture contained in the air in a control panel is condensed to form when the temperature of the air is varied by a change in temperature in the dish washing machine.

Additional aspects and/or advantages of the invention will be set forth in part in the description which follows and, in part, will be apparent from the description, or may be learned by practice of the invention.

The foregoing and/or other aspects of the present invention are achieved by providing a dish washing machine which includes a main body having a washing tub, a door hinged with the main body, and opening and closing the washing tub, a control panel provided to the door, and a partition provided between the door and the control panel so as to block wet vapor in the door from flowing to the control panel.

According to an aspect of the present invention, the partition is provided at a lower portion of the control panel, and causes the control panel and the door to be partitioned up and down, respectively.

Further, according to an aspect of the present invention, the partition includes a first partition and a second partition separated apart from the first partition by a predetermined distance. According to an aspect of the present invention, the first and second partitions include a through-hole therebetween through which a cable passes, and the through-hole is closed by a blockage member having an insertion hole for the cable, and prevents the wet vapor from flowing into the control panel through the through-hole.

Further, according to an aspect of the present invention, the first and second partitions include sealing members at edges thereof, and the sealing members seal spaces between an inner wall of the door and the edges of the first and second partitions.

Further, according to an aspect of the present invention, the first and second partitions have a shape of a flat plate.

Furthermore, the first and second partitions include inclined top surfaces along which water droplets condensed in the control panel are smoothly discharged, and include drain holes on one end thereof.

In addition, according to an aspect of the present invention, the drain holes include a cross section that is reduced from top to bottom in order to prevent the wet vapor from being penetrated from the bottom.

It is another aspect of the present invention to provide a dish washing machine, which includes a main body having a washing tub, a door hinged with the main body, and opening and closing the washing tub, and including a control panel, and a partition provided to the control panel, and causing the door and the control panel to be partitioned to separate an internal space of the door from an internal space of the control panel and to block wet vapor in the door from flowing to the control panel.

According to an aspect of the present invention, the control panel is provided at an inner upper portion of the door, and the partition is provided at a lower portion of the control panel.

Further, according to an aspect of the present invention, the partition includes a shape of a flat plate.

Further, according to an aspect of the present invention, the partition includes an inclined top surface to discharge water droplets which wet vapor contained in air of the internal space of the control panel is condensed to form by a change in temperature, and a drain hole formed at a lowest portion of the inclined top surface, and to guide the water droplets to be discharged to a lower portion of the door. According to an aspect of the present invention, the drain hole includes a cross section which is reduced from top to bottom in order to prevent the wet vapor from being penetrated from the lower portion of the door.

In addition, the partition includes a first partition and a second partition separated apart from the first partition by a predetermined distance. The first and second partitions includes a through-hole therebetween through which a cable passes, and the through-hole is closed by a blockage member having an insertion hole for the cable, and prevents the wet vapor from flowing into the control panel through the through-hole.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
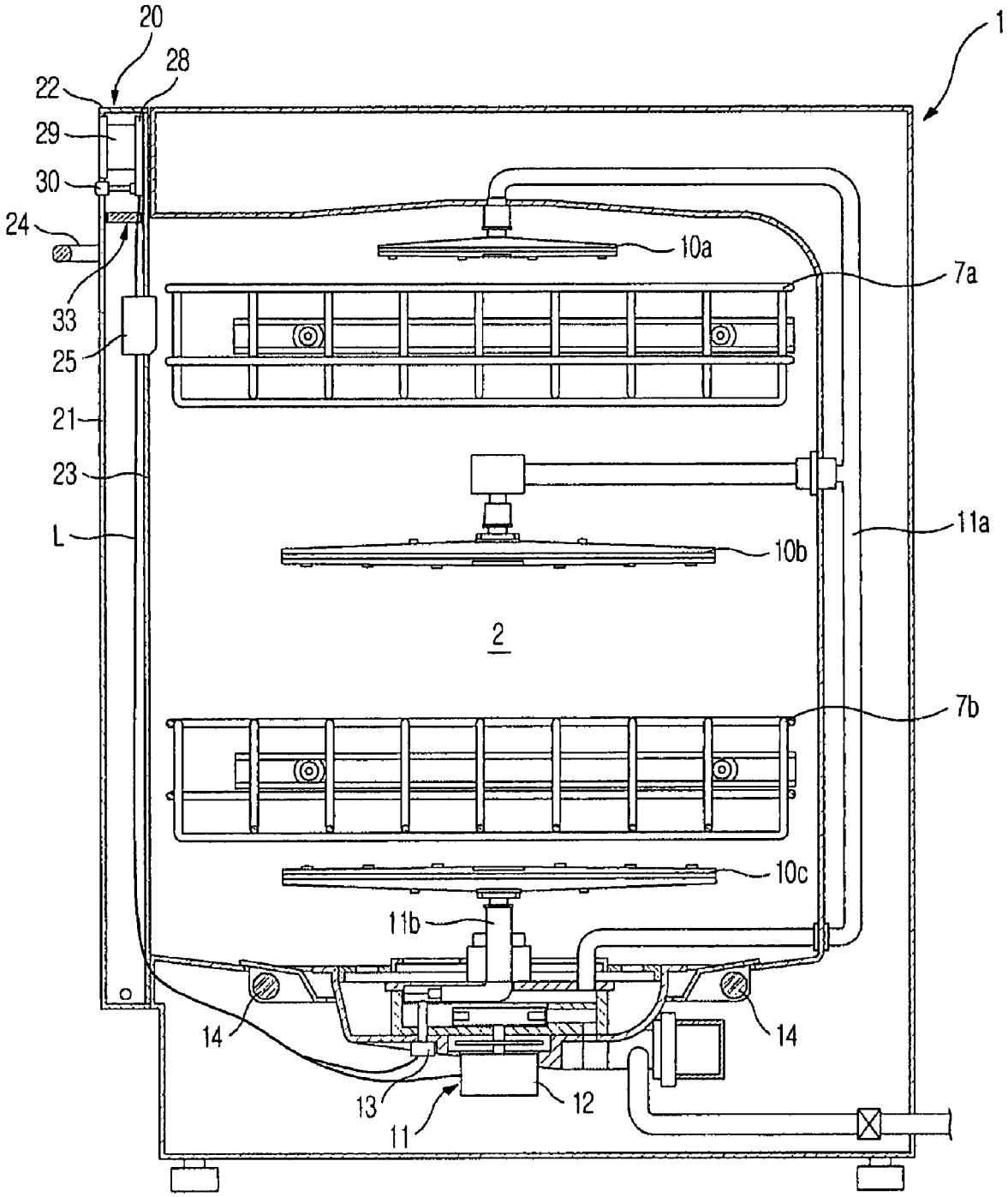
FIG. 1 is a side sectional view illustrating a dish washing machine according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

As illustrated in FIG. 1, a dish washing machine according to the present invention comprises a main body 1, a washing tub 2 formed in the main body 1 which is open in front thereof, dish receptacles 7*a* and 7*b* that are slidably provided in the washing tub 2 and hold dishes, rotary spray nozzles 10*a*, 10*b* and 10*c* that spray high-pressure washing water upon the dish receptacles 7*a* and 7*b*, guide pipes 11*a* and 11*b* that guide the washing water to the rotary spray nozzles 10*a*, 10*b* and 10*c*, and a sump 11 that is connected with the guide pipes 11*a* and 11*b*, and pumps the washing water toward the rotary spray nozzles 10*a*, 10*b* and 10*c*. The sump 11 includes a pump motor 12 driving a washing pump, a channel switching valve 13 switching a fluid channel in the sump, and a heater 14 surrounds the sump 11 under the washing tub 2 and heats the washing water.

A door 20 opening and closing the washing tub 2 is provided in front of the main body 1. The door 20 comprises a front panel 21 provided at the front thereof, a rear panel 23 provided at the rear thereof, a control panel 22 provided at an upper portion of the front panel 21, and a grip 24 provided at the front of the front panel 21, wherein the front panel 21, the rear panel 23, and the control panel 22 forms an external appearance of the door.

The rear panel 23 is provided with a detergent box 25 supplying a detergent required for the washing.

The control panel 22 comprises operation buttons 30 used to operate the dish washing machine, a display unit 29 that displays an operation state of the dish washing machine with symbols such as digits, and a printed circuit board (PCB) 28 that is connected with the operation buttons 30 and the display unit 29.

A rib-like or plate-like partition 33 extending from an inside of the control panel 22 is provided under the PCB 28, the operation buttons 30, and the display unit 29. The partition 33 partitions between an internal space of the control panel 22 and a space between the front panel 21 and the rear panel 23.

Meanwhile, a cable L for transmitting a control signal to the pump motor 12, the channel switching valve 13, etc. is connected with the PCB 28. The cable L is also connected with the pump motor 12, the channel switching valve 13, etc. by extending to a lower portion of the main body 1 via an internal space of the door 20.

Figure 2:
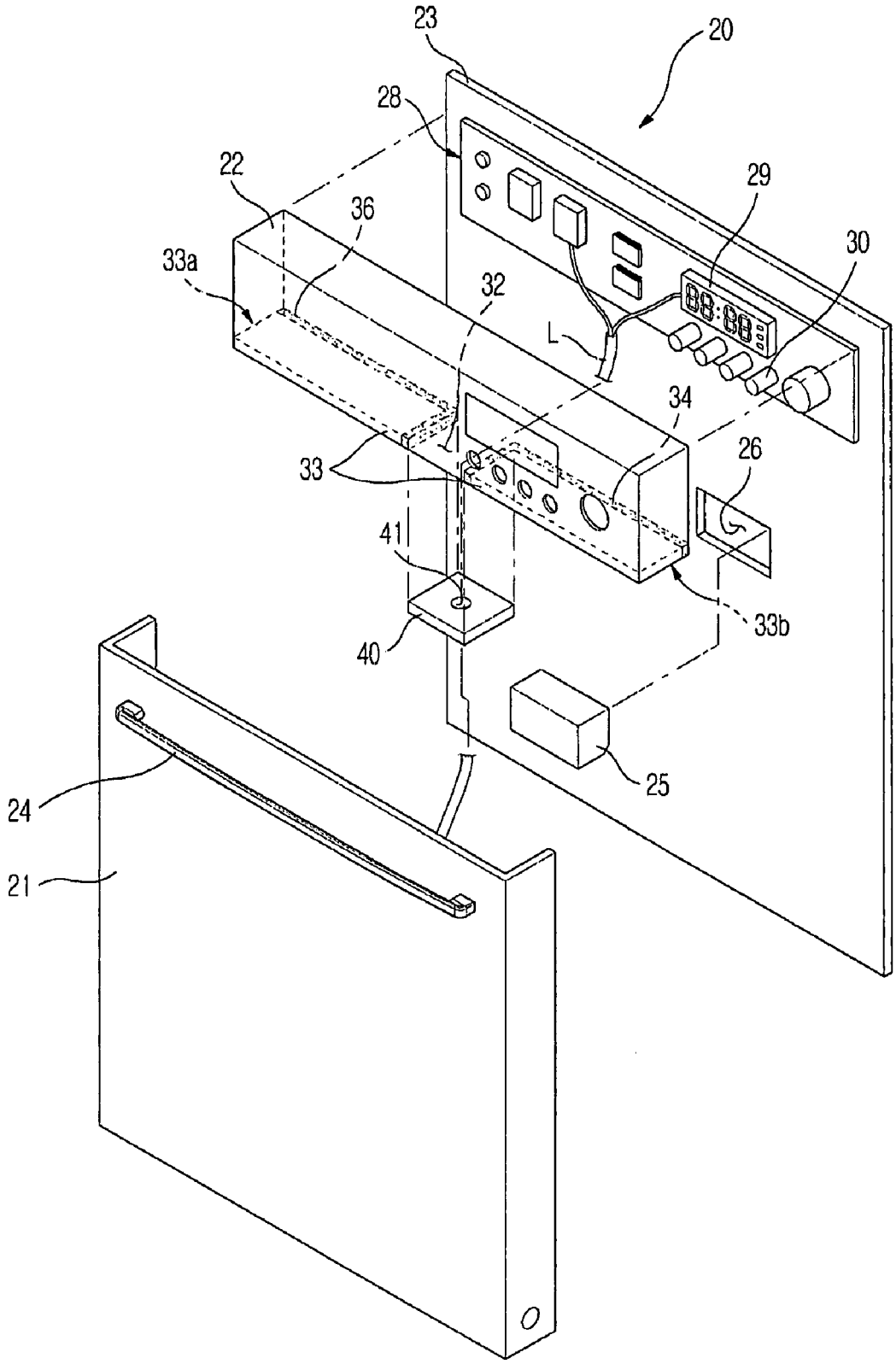
FIG. 2 is an exploded perspective view illustrating a partition according to a first embodiment of the present invention.

As shown in FIG. 2, the front panel 21 is open upwards. The control panel 22 is placed on the front panel 21. The partition 33 partitions between an internal space of the control panel 22 and a lower space of the door 20, i.e. a space defined between the front panel 21 and the rear panel 23, thereby isolating both from each other.

Here, the partition 33 is provided at a lower portion of the control panel 22, and a through-hole 32 having a predetermined area is provided at the center of the partition 33. Thus, the partition 33 comprises a first partition 33*a* located on one side of the control panel 22, and a second partition 33*b* located on the other side of the control panel 22. Here, the through-hole 32 is a passage for allowing the cable L extending from the PCB 28 to extend toward the lower portion of the door.

An edge of each of the first and second partitions 33*a* and 33*b* is partially in contact with the rear panel 23 via a corresponding sealing member 36.

However, the through-hole 32 is closed by a separate blockage member 40 so as to prevent wet vapor from rising from the lower portion of the door to the control panel 22. To this end, the blockage member 40 has a size corresponding to that of the through-hole 32, and is provided with an insertion hole 41 having the same diameter as the cable L at the center thereof, so that the cable L extends to the lower portion of the door 20 through the insertion hole 41.

In addition, the rear panel 23 comprises an opening 26 for installing the detergent box 25. The detergent box 25 is inserted into the opening 26 toward the washing tub (see FIGS. 1 and 2).

Figure 3:
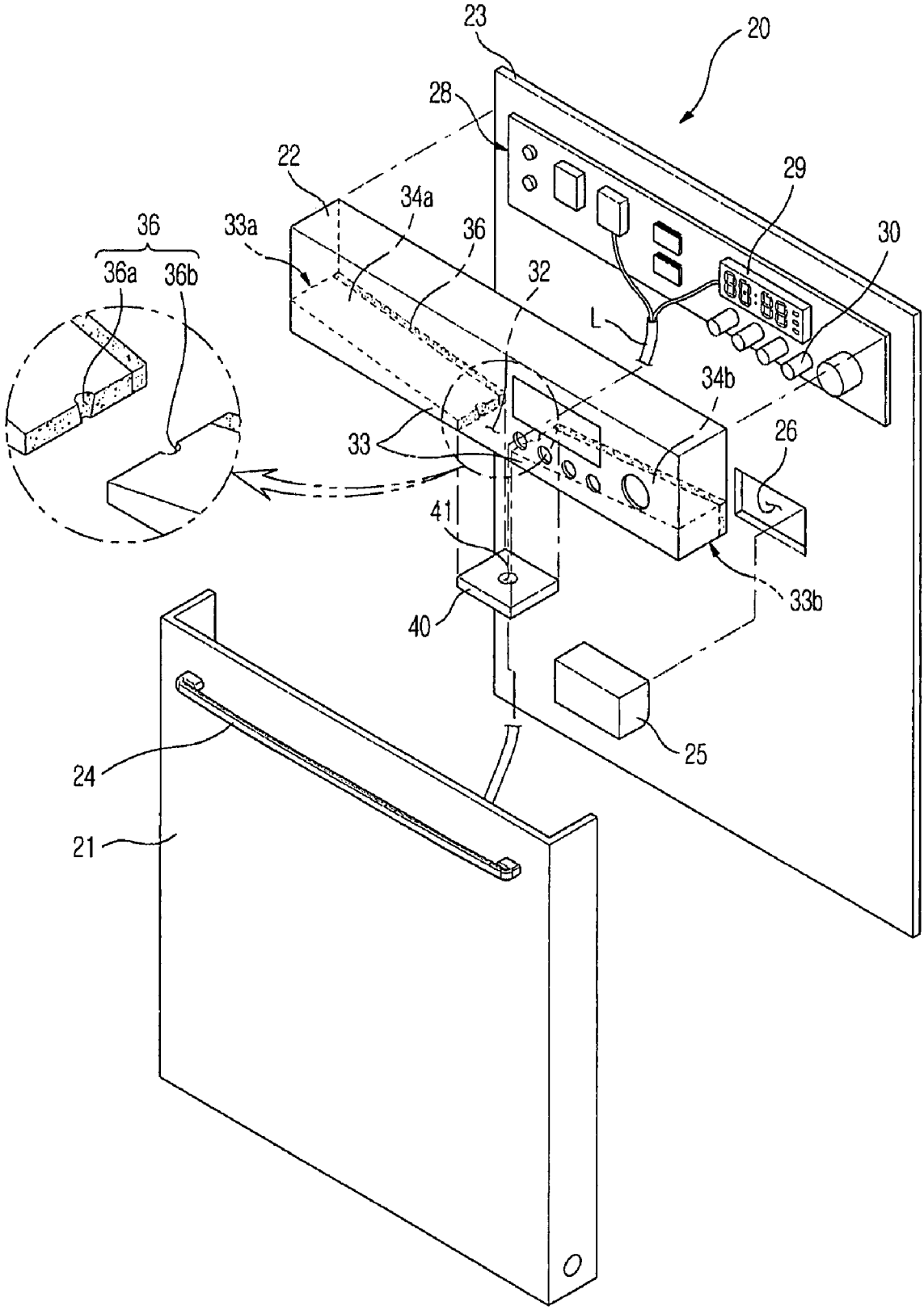
FIG. 3 is an exploded perspective view illustrating a partition according to a second embodiment of the present invention.

FIG. 3 illustrates a partition according to another embodiment of the present invention. Here, the partition 33 comprises first and second partitions 33*a* and 33*b* that have inclined top surfaces 34*a* and 34*b*, which are inclined downwards to the through-hole 32.

A boundary between the first partition 33*a* and the through-hole 32 is provided with a first drain hole 36*a*. Similarly, a boundary between the second partition 33*b* and the through-hole 32 is also provided with a second drain hole 36*b*. Each of the first and second drain holes 36*a* and 36*b* cone-shaped, a cross section of which is reduced from top to bottom.

Therefore, the first and second partitions 33*a* and 33*b* comprise the inclined top surfaces 34*a* and 34*b*, and first and second drain holes 36*a* and 36*b* at one ends thereof for discharging tiny water droplets, which can be produced inside the control panel 22, when the air inside the control panel 22 is heated and cooled due to a change in temperature inside the washing tub, toward the lower side of the door 20 through the first and second drain holes 36*a* and 36*b*.

Specifically, the water droplets formed on a sidewall of the control panel 22 or the inclined top surfaces 34*a* and 34*b* move to the drain holes 36*a* and 36*b* by means of the inclined top surfaces 34*a* and 34*b*, and then the water droplets passing through the drain holes 36*a* and 36*b* fall to the lower side of the door 20.

However, the water droplets formed in this way are small enough to be eliminated by natural evaporation without providing a separate drain hole on the lower side of the door.

Hereinafter, the operation of the dish washing machine according to an embodiment of the present invention will be described with reference to the attached drawings.

Figure 4:
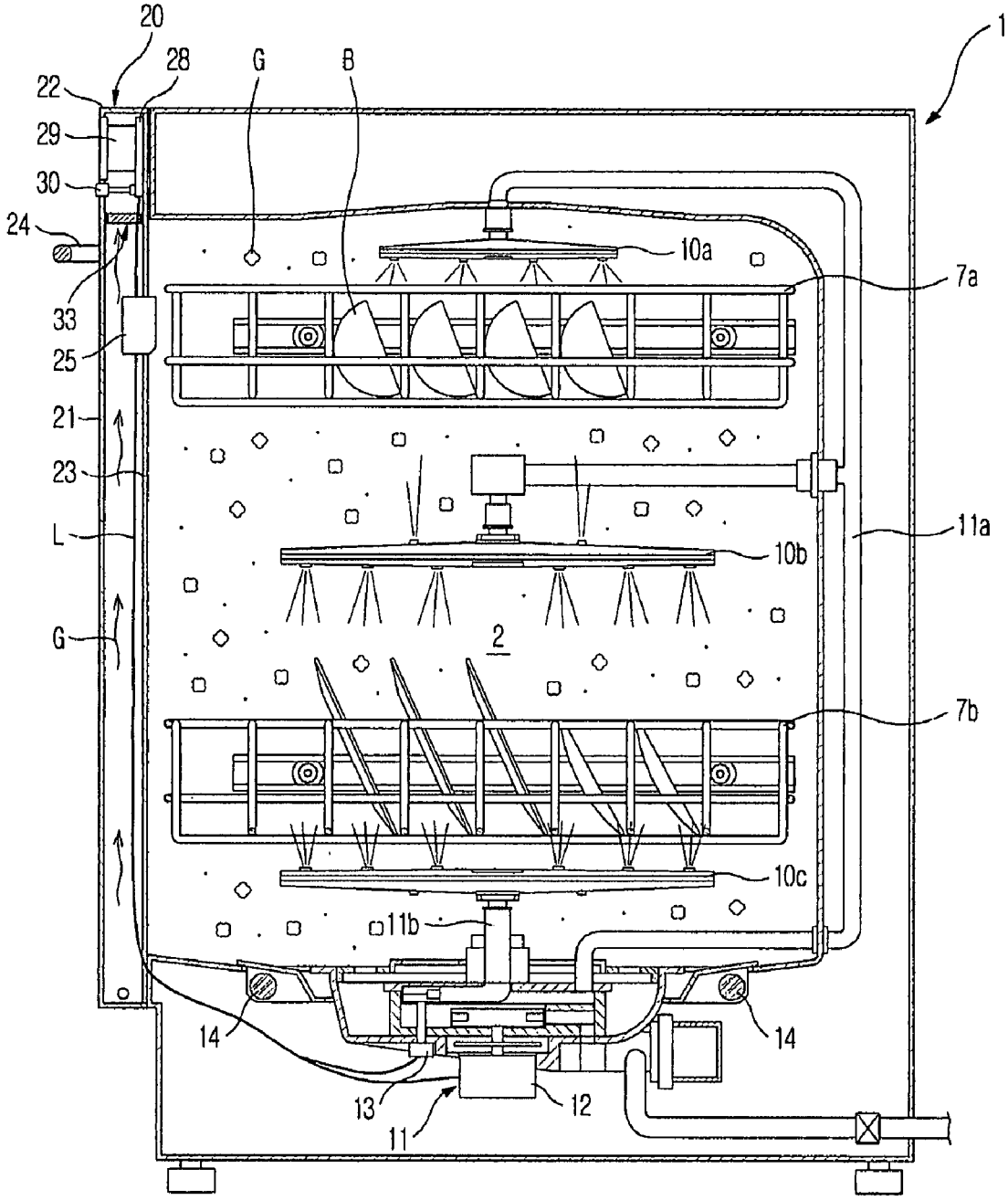
FIG. 4 is a side sectional view illustrating the function of a partition according to a first embodiment of the present invention.

As shown in FIG. 4, when a user puts dishes B onto dish receptacles 7*a* and 7*b*, closes the door 20 to seal the washing tub 2, and pushes the operation buttons 30 to operate the dish washing machine, washing water flows into the washing tub 2.

The washing water flowing into the washing tub 2 runs on the bottom of the washing tub 2, is heated by the heater 14 around the sump 11, flows into the sump 11, moves to the rotary spray nozzles 10*a*, 10*b* and 10*c* along the guide pipes 11*a* and 11*b* connected with the sump 11 by means of pumping of the sump 11, and is sprayed out from the rotary spray nozzles 10*a*, 10*b* and 10*c*, remains attached to the dishes B are removed.

The dish washing comprises preliminary washing and main washing. During the preliminary washing, only the washing water is sprayed. During the main washing, the detergent contained in the detergent box 25 falls into the washing tub 2, and is mixed with the washing water, thereby washing the dishes.

In the case of the preliminary and main washing, the temperature of the washing water is gradually increased by the heater 14. When the temperature of the washing water reaches from about 55 degrees to about 70 degrees, wet vapor is generated inside the washing tub 2.

In this manner, the increase of the temperature inside the washing tub 2 and the resulting generation of the wet vapor G, which are caused by the increase of the temperature of the washing water, have influence on the state of the internal air of the door 20. In this case, the wet vapor G inside the washing tub 2 can flow into the door 20 through a minute gap of the door 20. This wet vapor G flows upward in a space between the front panel 21 and the rear panel 23, and then moves toward the control panel 22.

However, the wet vapor G does not move upwards by means of the partition 33 under the control panel 22, and thus is prevented from flowing into the control panel 22.

Figure 5:
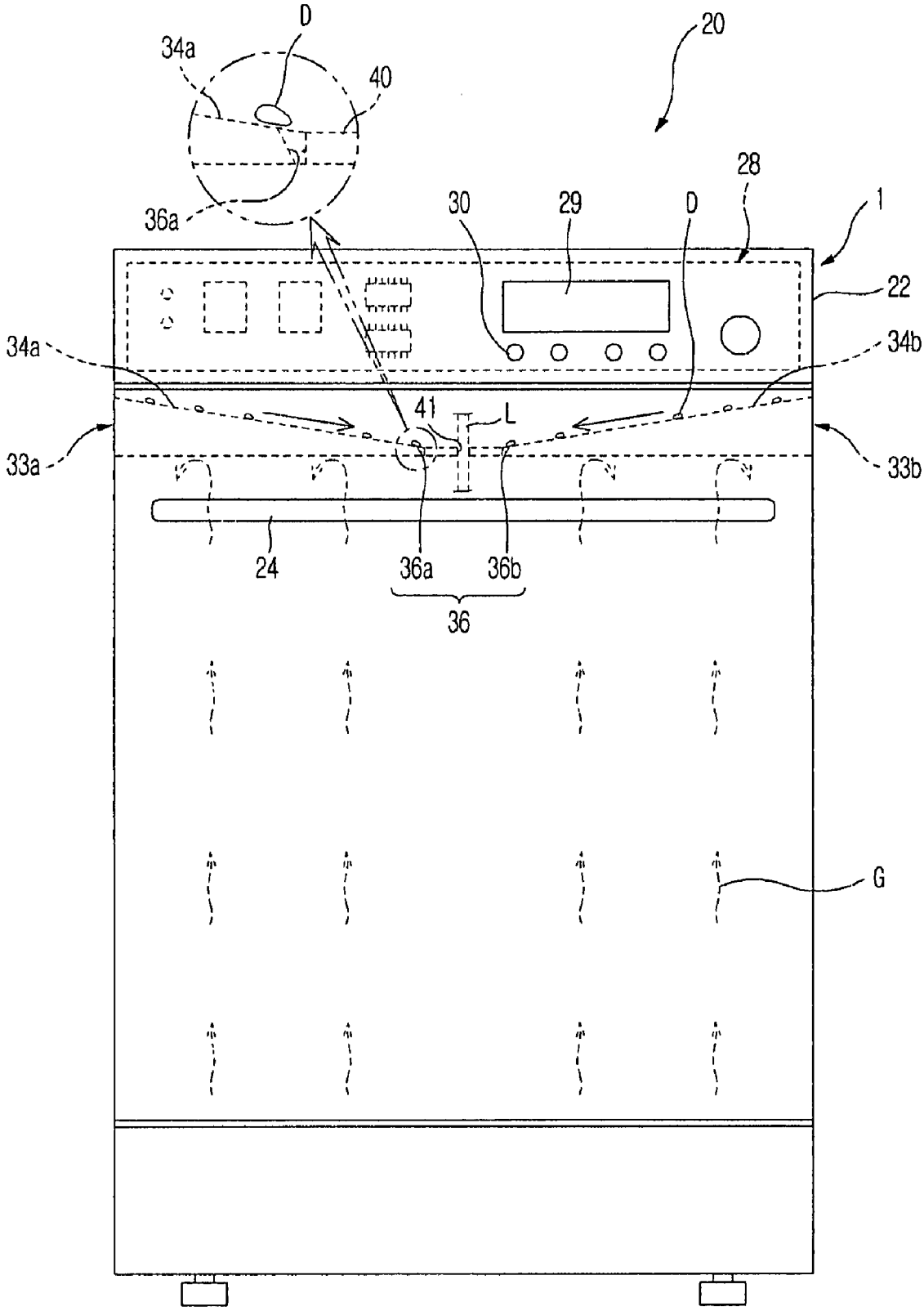
FIG. 5 is a front view illustrating the function of a partition according to a second embodiment of the present invention.

FIG. 5 illustrates the operation of the dish washing machine having a partition according to another embodiment of the present invention. Here, although the wet vapor G rises up toward the control panel 22, it does not rise up by means of the first and second partitions 33*a* and 33*b*.

However, as long as the inside of the control panel 22 is not in a vacuum state, it is filled with air, and thus, the temperature change of the washing tub 2 (see FIG. 4) exerts influence on the temperature of the air contained in the inside of the control panel 22. The heating and cooling resulting from the washing water causes the air of the inside of the control panel 22 to be heated and then cooled naturally after the operation of the dish washing machine is stopped. At this time, the small water droplets are formed on the control panel 22.

In this case, the water droplets D flow across the inclined top surfaces 34*a* and 34*b* toward the drain holes 36, and thus fall to the lower side of the door 20 through the drain holes 36. Thereby, it is possible to prevent an accident in the control panel 22 due to the remaining water droplets D.

As described above, because the cross section of each drain hole 36 is reduced from top to bottom, the water droplets D are easy to be discharged from top to bottom of the drain holes 36, but the wet vapor G is very difficult to be introduced from bottom to top of the drain holes 36. Although the wet vapor is introduced, its inflow is very insignificant compared to that of the related art. Thus, a possibility of the wet vapor influencing electrical and electronic elements in the control panel 22 is very restricted. Further, when the air in the control panel 22 is cooled, the wet vapor is condensed and discharged to the lower portion of the control panel 22 by means of the inclined top surfaces 34*a* and 34*b* and the drain holes 36.

As can be seen from the foregoing, according to an embodiment of the present invention, since a large quantity of wet vapor can be blocked from flowing from the lower portion of the door into the control panel, it is possible to eliminate a possibility of the wet vapor influencing the electrical and electronic elements in the control panel to give rise to an accident.

Further, when a small quantity of wet vapor contained in the air in the control panel is condensed into water droplets by the temperature change of the washing tub, the water droplets can be discharged out of the control panel, and thus accidents, such as short-circuit, of the electrical and electronic elements in the control panel can be prevented.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A dish washing machine comprising:

a main body comprising a washing tub;

a plurality of dish receptacles provided in the washing tub;

a plurality of rotary spray nozzles to spray washing water on the dish receptacles;

a door hinged with the main body, and opening and closing the washing tub;

a control panel provided to the door; and at least one partition provided between the door and the control panel so as to block wet vapor in the door from flowing to the control panel, wherein:

the at least one partition comprises at least one inclined top surface along which water droplets condensed in the control panel is smoothly discharged, the at least one inclined top surface being inclined downwards towards a center of dishwashing machine in a width-wise direction, and a cable passing through a hole is formed by the at least one partition.

2. The dish washing machine as claimed in claim 1, wherein the partition is provided at a lower portion of the control panel, and causes the control panel and the door to be partitioned up and down, respectively.

3. The dish washing machine as claimed in claim 2, wherein:

the partition comprises a first partition and a second partition separated apart from the first partition by a predetermined distance;

the hole is formed between the first and second partitions through which the cable passes;

the hole is closed by a blockage member comprising an insertion hole for the cable, and prevents the wet vapor from flowing into the control panel through the hole; and the insertion hole having a same diameter as the cable at the center thereof, so that the cable extends through the insertion hole.

4. The dish washing machine as claimed in claim 3, wherein:

the first and second partitions comprise sealing members at edges thereof; and the sealing members seal spaces between an inner wall of the door and the edges of the first and second partitions.

5. The dish washing machine as claimed in claim 3, wherein the first and second partitions comprise a shape of a flat plate.

6. The dish washing machine as claimed in claim 3, wherein:

the first and second partitions comprise drain holes on one end thereof.

7. The dish washing machine as claimed in claim 6, wherein the drain holes comprise a cross section which is reduced from top to bottom in order to prevent the wet vapor from being penetrated from the bottom.

8. The dish washing machine as claimed in claim 6, wherein the drain holes comprises a cross section which decreases from a top to a bottom of the drain hole in a cone-shape.

9. A dish washing machine comprising:

a main body comprising a washing tub;

a plurality of dish receptacles provided in the washing tub;

a plurality of rotary spray nozzles to spray washing water on the dish receptacles;

a door hinged with the main body, and opening and closing the washing tub;

a control panel provided to the door; and a partition provided to the control panel, and causing the door and the control panel to be partitioned to separate an internal space of the door from an internal space of the control panel and to block wet vapor in the door from flowing to the control panel, wherein:

the control panel is provided at an inner upper portion of the door, and the partition is provided at a lower portion of the control panel;

the partition comprises:

an inclined top surface to discharge water droplets which wet vapor contained in air of the internal space of the control panel is condensed to form by a change in temperature, the inclined top surface being inclined downwards towards a center of the dishwashing machine in a width-wise direction, a drain hole which is formed at a lowest portion of the inclined top surface, and guides the water droplets to be discharged to a lower portion of the door, and a cable passing through a hole formed by the partition.

10. The dish washing machine as claimed in claim 9, wherein the partition comprises a shape of a flat plate.

11. The dish washing machine as claimed in claim 9, wherein:

the drain hole comprises a cross section which is reduced from top to bottom in order to prevent the wet vapor from being penetrated from the lower portion of the door.

12. The dish washing machine as claimed in claim 10, wherein:

the partition comprises a first partition and a second partition separated apart from the first partition by a predetermined distance;

the first and second partitions comprise the hole therebetween through which the cable passes; and the hole is closed by a blockage member comprising an insertion hole for the cable, and prevents the wet vapor from flowing into the control panel through the hole.

13. The dish washing machine as claimed in claim 8, wherein:

the partition comprises a first partition and a second partition separated apart from the first partition by a predetermined distance;

the first and second partitions comprise the hole therebetween through which the cable passes;

the hole is closed by a blockage member to prevent the wet vapor from flowing into the control panel through the hole; and the blockage member comprises an insertion hole having a same diameter as the cable at the center thereof, so that the cable extends through the insertion hole.

14. A dish washing machine comprising:

a main body comprising a washing tub;

a plurality of dish receptacles provided in the washing tub;

a plurality of rotary spray nozzles to spray washing water on the dish receptacles; and a door comprising:

a front panel and a rear panel;

a control panel provided at an upper portion of the front panel; and a partition extending from an inside of the control panel to partition between an internal space of the control panel and a space between the front panel and the rear panel, to thereby block wet vapor in the door from flowing to the control panel, wherein:

the partition comprises a first partition located at one side of the control panel and a second partition located opposite the first partition;

the first and second partitions each comprise inclined top surfaces along which water droplets condensed in the control panel are discharged and drain holes at an end of each of the inclined top surfaces, to discharge the condensed water droplets, each of the inclined top surfaces being inclined downwards towards a center of the dishwashing machine in a width-wise direction; and a cable passing through a hole having a predetermined area provided therebetween the first partition and the second partition to allow the cable extending from a printed circuit board to extend toward the lower portion of the door.

15. The dish washing machine as claimed in claim 14, further comprising sealing members at edges of the first and second partitions respectively, to seal spaces between an inner wall of the door and the edges of the first and second partitions and wherein an edge of each of the first and second partitions is partially in contact with the rear panel via the corresponding sealing member.

16. The dish washing machine as claimed in claim 14, wherein the drain holes comprises a cross section which decreases from a top to a bottom of the drain hole in a cone-shape.

17. The dish washing machine as claimed in 13, wherein: the first and second partitions comprise sealing members at edges thereof; and the sealing members seal spaces between an inner wall of the door and the edges of the first and second partitions.

18. The dish washing machine as claimed in 14, wherein:

the hole is closed by a blockage member to prevent the wet vapor from flowing into the control panel through the hole; and the blockage member comprises an insertion hole having a same diameter as the cable at the center thereof, so that the cable extends through the insertion hole.

* * * * *

UNITED STATES PATENT AND TRADEMARK OFFICE

CERTIFICATE OF CORRECTION

PATENT NO. : 8,262,807 B2
APPLICATION NO. : 11/976068
DATED : September 11, 2012
INVENTOR(S) : Wang Seok Son It is certified that error appears in the above-identified patent and that said Letters Patent is hereby corrected as shown below:

In the Claims:

Column 6; Line 34; In Claim 1, after "hole" delete "is".
Column 8; Line 46; In Claim 17, delete "13," and insert -- claim 13, --, therefor.
Column 8; Line 51; In Claim 18, delete "14," and insert -- claim 14, --, therefor.

Signed and Sealed this
Fourteenth Day of May, 2013

Teresa Stanek Rea
*Acting Director of the United States Patent and Trademark Office*